US006814310B2

(12) United States Patent
Boger

(10) Patent No.: US 6,814,310 B2
(45) Date of Patent: Nov. 9, 2004

(54) METERED LIQUID DISPENSING SYSTEM

(75) Inventor: Bentley J. Boger, Altanta, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/304,503

(22) Filed: Nov. 26, 2002

(65) Prior Publication Data

US 2004/0099752 A1 May 27, 2004

(51) Int. Cl.[7] ..... B05B 1/14

(52) U.S. Cl. ..... 239/548; 222/132; 222/135; 222/330; 239/302; 239/390; 239/562; 239/596

(58) Field of Search ..... 239/68, 135, 298, 239/302, 303, 304, 305, 390, 548, 562, 566, 596, 598; 222/132, 135, 146.5, 330

(56) References Cited

U.S. PATENT DOCUMENTS

| | | | | |
|---|---|---|---|---|
| 4,708,619 A | | 11/1987 | Balk | 425/141 |
| 5,000,112 A | | 3/1991 | Rothen et al. | 118/411 |
| 5,533,675 A | * | 7/1996 | Benecke et al. | 239/424.5 |
| 5,605,720 A | | 2/1997 | Allen et al. | 427/288 |
| 5,683,752 A | | 11/1997 | Popp et al. | 427/421 |
| 6,070,764 A | * | 6/2000 | Cline et al. | 222/135 |
| 6,089,413 A | | 7/2000 | Riney et al. | 222/318 |
| 6,341,719 B2 | * | 1/2002 | Villa | 222/135 |
| 6,422,428 B1 | | 7/2002 | Allen et al. | 222/318 |
| 6,435,425 B1 | | 8/2002 | Saidman | 239/290 |
| 6,601,741 B2 | * | 8/2003 | McGuffey | 239/135 |

FOREIGN PATENT DOCUMENTS

| | | |
|---|---|---|
| DE | 10015739 A1 | 4/2001 |
| EP | 0819477 A2 | 1/1998 |

OTHER PUBLICATIONS

Nordson Corporation, *ProLink™ Series Metering Heads*, Brochure, 2 pgs., 1995.

* cited by examiner

*Primary Examiner*—Sheldon J Richter
(74) *Attorney, Agent, or Firm*—Wood, Herron & Evans, L.L.P.

(57) ABSTRACT

A liquid material dispensing system provides individually metered streams of liquid material to a nozzle or die tip which dispenses the liquid material in a closely spaced arrangement. In one embodiment, the dispensing system utilizes a series of gear pumps to induce the flow of liquid material through individual dispensing modules. An adapter intermediate the modules and the die tip directs the individually controlled streams from a spacing provided by the modules to a close arrangement, such as may be suitable for coating parallel strands of substrate material.

12 Claims, 4 Drawing Sheets

METERED LIQUID DISPENSING SYSTEM

FIELD OF THE INVENTION

The present invention relates to liquid material dispensing systems, and more particularly to apparatus and methods for dispensing multiple streams of liquid material to a substrate.

BACKGROUND OF THE INVENTION

Liquid material dispensing systems are known in the art and generally comprise a liquid dispensing applicator having one or more dies configured to dispense the liquid material as filaments, ribbons, or other shapes. Applicators are available in many different configurations and are generally constructed to dispense liquid material in a specific form. For example, applicators for dispensing liquid material as filaments may have dies which include multiple liquid discharge outlets, or they may have multiple dies, each having a single liquid discharge outlet. In each configuration, however, the liquid material dispensed from each discharge outlet of a die is controlled by a single pressure source.

Often it is desired to apply liquid material to a substrate in the form of multiple filaments. For example, the coating of multiple strands of elastic substrate material, such as Lycra®, for the manufacture of elasticized products can require individual filaments of liquid material to be dispensed onto each strand of the substrate. Because the elastic strands are typically arranged close to one another, usually spaced only a few millimeters apart, the coating of such strands is suited to liquid dispensing systems utilizing dies having multiple liquid outlets which are spaced apart a distance that corresponds to the spacing of the elastic strands. Accordingly, the coating of multiple strands of substrate material is typically accomplished by utilizing systems having dies with multiple liquid discharge outlets that are fed from a common source of pressurized liquid. One example of this type of die is described in U.S. Pat. No. 6,435,425, assigned to the assignee of the present invention.

One drawback of utilizing dies with multiple liquid discharge outlets to coat closely spaced strands of substrate material is that the multiple liquid discharge outlets are coupled to a common pressure source for dispensing the liquid material through the multiple outlets. Accordingly, in low flow-rate applications, the restriction of flow at one or more of the outlets is accommodated by increased flow at the remaining outlets of the die. This restriction in flow may be due to variation of local temperatures within the die that cause increased viscosity of the liquid material, contaminants in the liquid material, or a thick slug of liquid material moving through the die and restricting one or more of the outlets. Because the restriction in flow is accommodated by other outlets of the die, the dispense rate may not be equal across all outlets, causing uneven coating of the individual strands of substrate material. In the worst case, one or more outlets may become completely clogged while flow is accommodated by the other outlets. The result is a substrate material having an excessively heavy coating on some strands and no coating on other strands. To exacerbate the problem, conventional multi-outlet dies do not facilitate unclogging the blocked outlet, whereby the problem will continue until the dispensing system is shut down and fixed manually.

There is thus a need for an adhesive dispensing system utilizing dies with multiple liquid discharge outlets which overcomes drawbacks of the prior art, such as those described above.

SUMMARY OF THE INVENTION

The present invention provides a liquid dispensing system for dispensing liquid material from a plurality of liquid discharge outlets in a closely spaced arrangement and wherein the dispense rate from each of the liquid discharge outlets is independent of flow of liquid material from the other outlets. In one aspect of the invention, each liquid discharge outlet is in fluid communication with a flow-metering device, which controls the flow of liquid material from the outlet. This arrangement is particularly suited for low flow dispense rates and ensures that any restriction of flow through one liquid discharge outlet does not affect the flow of liquid from the remaining liquid discharge outlets. Furthermore, the system facilitates unclogging blocked liquid discharge outlets in that the restriction of flow through a blocked outlet increases pressure with respect to that outlet to thereby aid in the removal of the blockage.

In another aspect, the liquid dispensing system includes an adapter coupled between a die tip and a plurality of liquid dispensing modules. The adapter is configured to direct liquid material from each liquid dispensing module to respective liquid discharge passages on the die tip. Accordingly, the adapter permits the use of a die tip having liquid discharge passages which are spaced apart to correspond to the spacing of strands of substrate material to be used with dispensing modules on an applicator which are coupled to discrete flow-metering devices.

In yet another aspect of the present invention, a method of dispensing liquid material to a substrate includes supplying the liquid material to an applicator with at least one die having a plurality of liquid discharge outlets, independently controlling the flow of the liquid material to each of the discharge outlets and forcing the liquid material through each of the discharge outlets.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
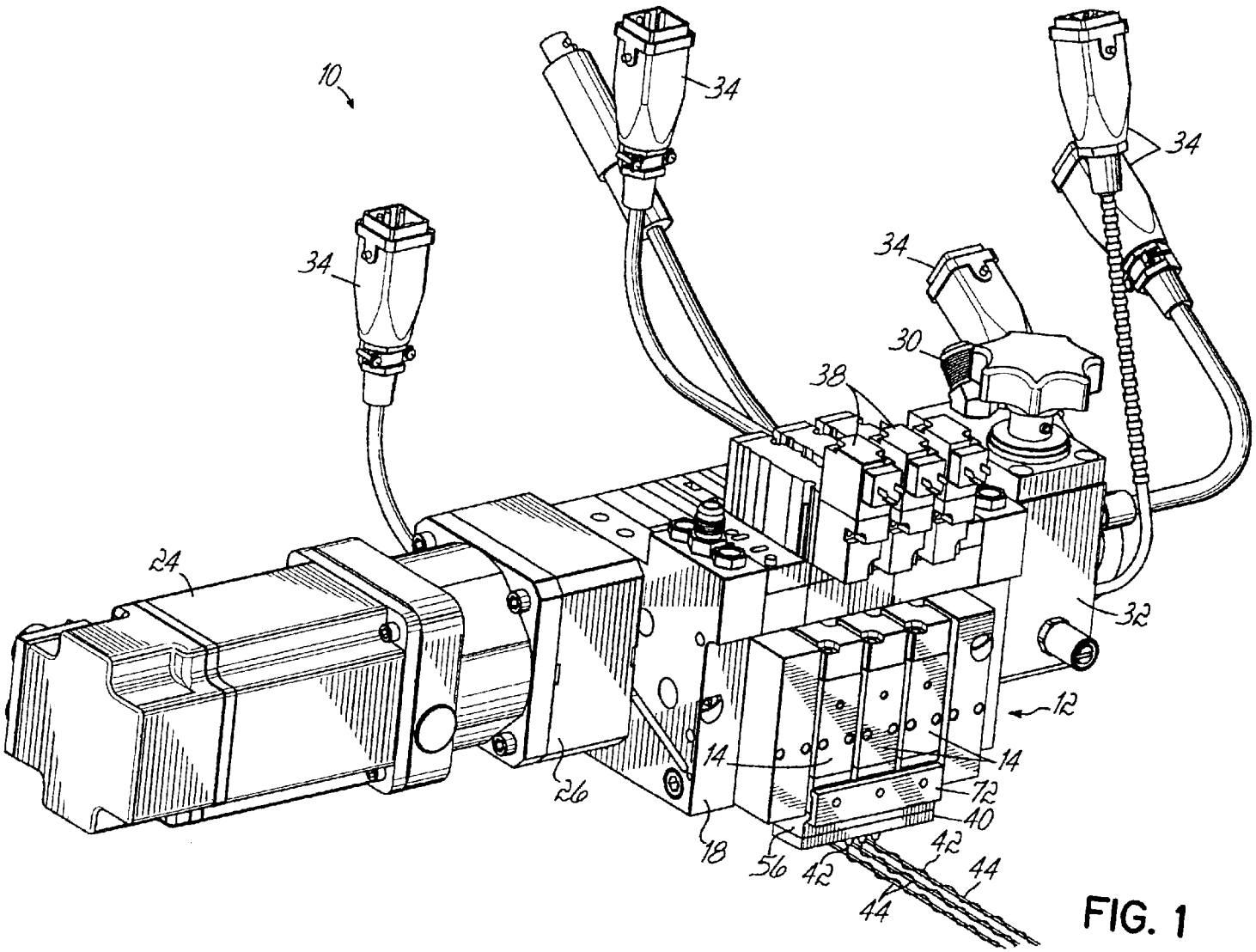
FIG. 1 is perspective view of an exemplary metered liquid dispensing system of the present invention.

FIG. 1 depicts an exemplary metered liquid dispensing system 10 of the present invention, including a liquid dispensing applicator 12 having a plurality of dispensing modules 14. The applicator 12 is configured to individually meter the flow of adhesive material through each module 14, whereby individually metered streams of liquid material may be dispensed to a substrate material. For example, individually metered filaments 42 of liquid material may be dispensed to parallel strands 44 of substrate material, as depicted in FIG. 1. One such applicator particularly suited to this type of operation is the Universal Slice™ Applicator, available from Nordson Corporation of Westlake, Ohio and disclosed in U.S. Pat. No. 6,422,428, assigned to the assignee of the present invention and herein incorporated by reference in its entirety.

Figure 2:
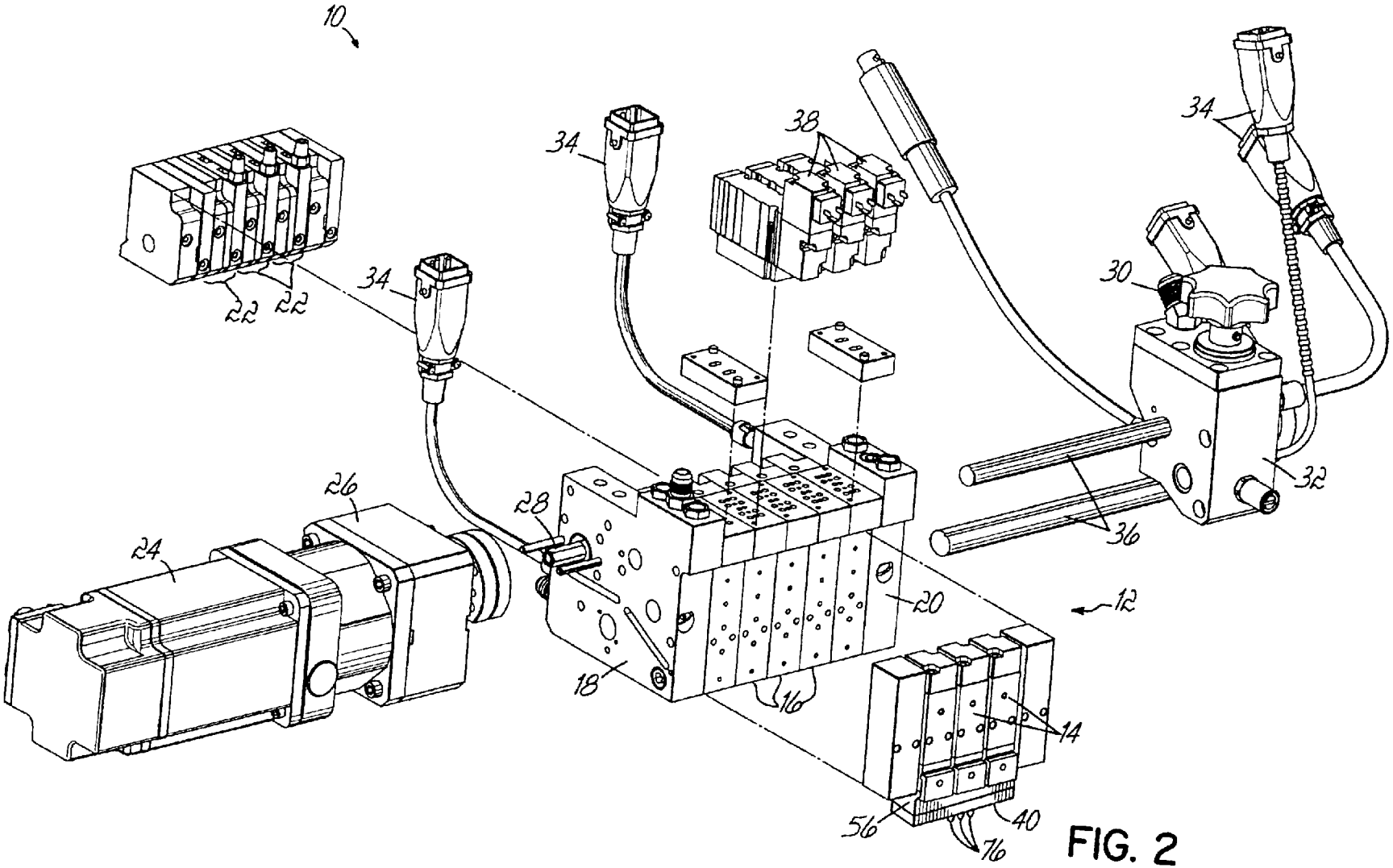
FIG. 2 is an exploded detail view of the dispensing system of FIG. 1.

Turning now to FIG. 2, the dispensing system 10 of FIG. 1 is shown in exploded detail. In this embodiment, the applicator 12 includes several manifold segments 16 which may be coupled together. Each manifold segment 16 is configured to supply liquid material to an individual module 14 that may be coupled to the manifold segment 16. The manifold segments 16 are sandwiched between endplates 18, 20 and secured by fasteners (not shown). The applicator 12 further includes several positive displacement pumps such as gear pumps 22, each gear pump 22 couplable to a respective manifold segment 16 and having liquid ports which mate with respective ports on an associated manifold segment 16. The gear pumps 22 meter the liquid material through respective manifold segments 16 and modules 14 to be dispensed from nozzles or die tips 40 coupled to the modules 14, as more fully described in U.S. Pat. No. 6,422,428.

In the exemplary embodiment shown, a motor 24 and gear box 26 are coupled to a drive shaft 28 which extends through each of the gear pumps 22 to thereby drive the gear pumps 22. Liquid material is provided to the applicator 12 through a liquid material input 30 located on a filter block 32 and the liquid material is filtered in the filter block 32 prior to being supplied to the manifold segments 16. The applicator 12 further includes electric cord sets 34 and heater rods 36 for heating the manifold segments 16. The applicator 12 also includes air control valves 38 which are couplable to the manifold segments 16 to provide pressurized process air to the modules 14. The process air may be dispensed by the modules 14 to attenuate and control the pattern of liquid material dispensed from the applicator 12. The applicator 12 of the present invention further includes a nozzle or die tip 40 configured to receive individual liquid material inputs from multiple modules 14 and to dispense the liquid material in an arrangement of closely spaced filaments or ribbons from a plurality of liquid discharge outlets. Advantageously, each filament or ribbon dispensed from the die tip 40 is associated with an individual flow-metering source, such as the gear pumps 22 of the exemplary embodiment, whereby the dispense rate of each liquid stream is independent the other liquid streams.

Figure 3:
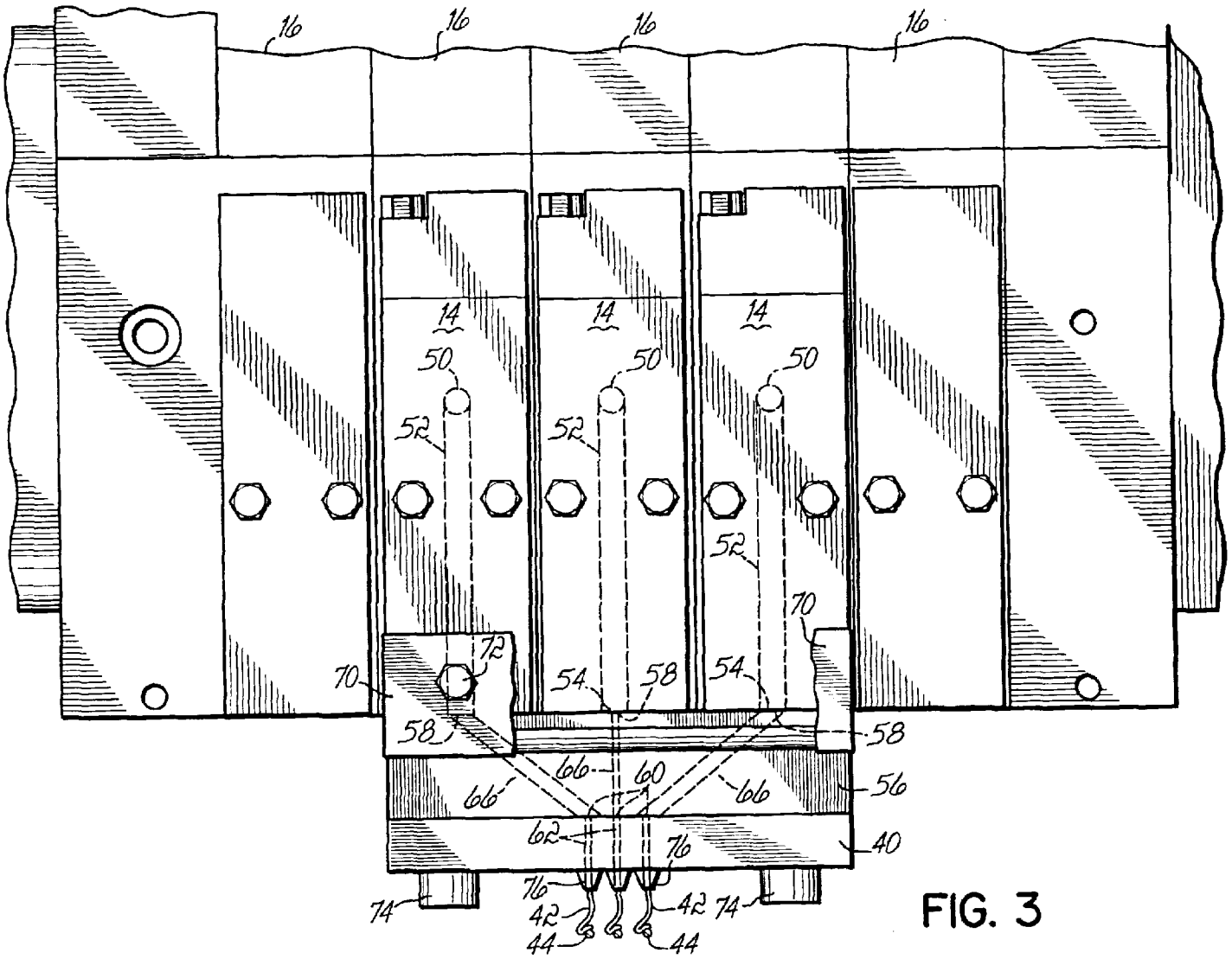
FIG. 3 is an elevational view illustrating a die tip and adapter plate of the dispensing system of FIG. 1.

Referring now to FIG. 3, the exemplary dispensing system 10 of the present invention is illustrated in operation to dispense closely spaced liquid filaments 42 to strands 44 of substrate material. This type of arrangement is particularly useful for coating closely spaced elastic strands for the manufacture of elasticized products, such as diapers and incontinence briefs. A typical arrangement of elastic strands may include, for example, 3 to 5 strands spaced on 5-mm centers. Such closely spaced strands cannot generally be coated by individual filaments dispensed from conventional modules, which typically may have center lines spaced about 5-cm apart in a close arrangement.

Figure 4:
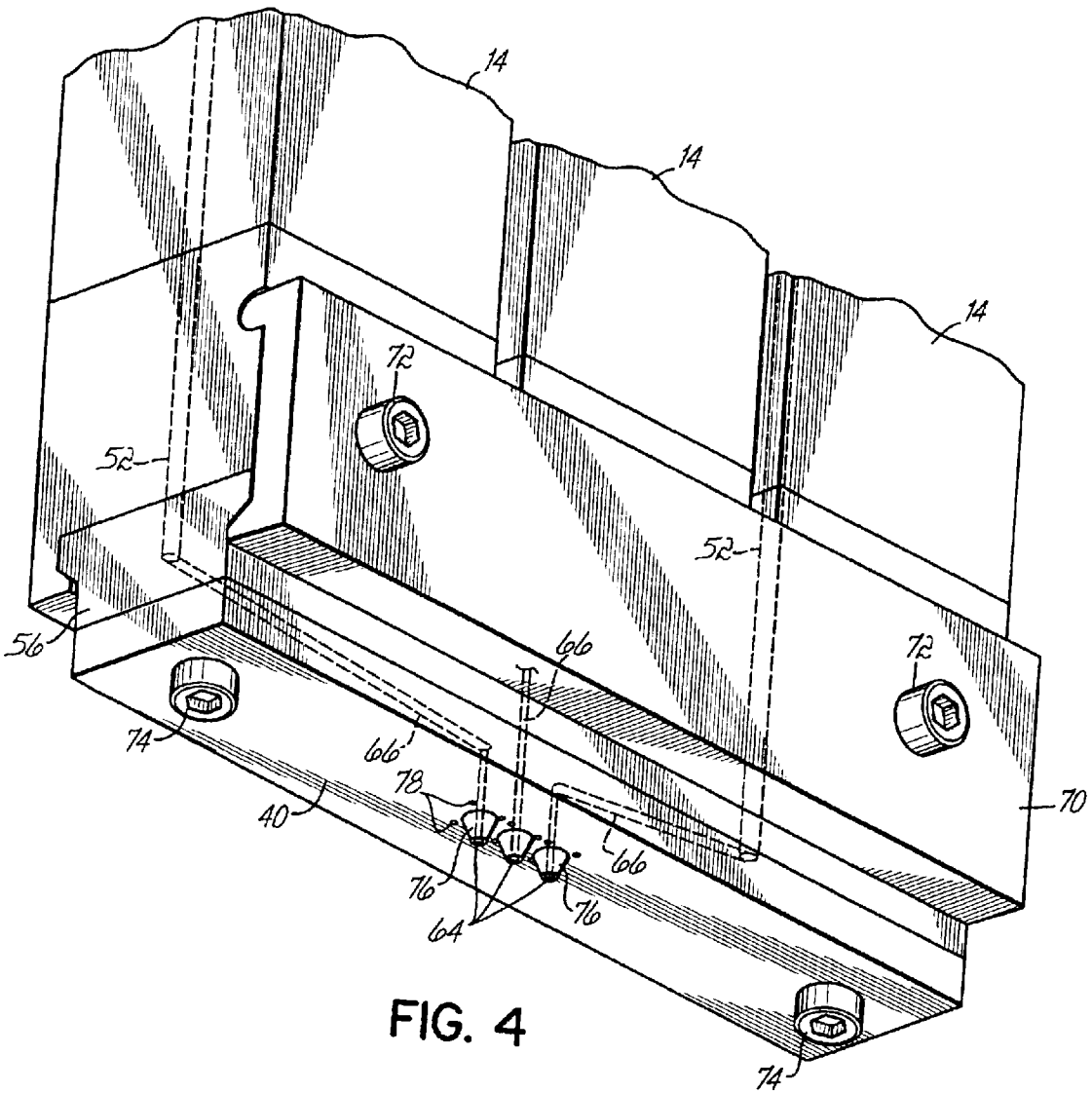
FIG. 4 is a perspective view of the die tip and adapter plate of FIG. 3.

With reference to FIGS. 3 and 4, each module 14 includes a liquid material supply port 50 for receiving liquid material from an associated manifold 16. Each liquid material supply port 50 is in fluid communication with a liquid discharge passage 52 which extends through the module 14 and terminates in an outlet port 54. The dispensing system 10 further includes an adapter 56 that is couplable between the modules 14 and the die tip 40. The adapter 56 has a series of inlet ports 58 which are sized and spaced to mate with the outlet ports 54 of the modules 14. The adapter 56 further includes a series of outlet ports 60 that are sized and spaced to mate with liquid discharge passages 62 in the die tip 40. The liquid discharge passages 62 in the die tip 40 terminate in liquid discharge outlets 64 (see FIG. 4) configured to dispense the liquid material to a substrate. Each inlet port 58 on the adapter 56 is in fluid communication with a corresponding outlet port 60 by liquid passages 66 extending through the adapter 56. Accordingly, the adapter 56 directs individual streams of liquid material from each module 14 to a respective liquid discharge passage 62 on the die tip 40 whereby the spacing of the liquid discharge passages corresponds to a desired spacing of the strands of substrate material.

Turning now to FIG. 4, the adapter 56 may be secured to the modules 14 by a cover plate 70 and fasteners 72. The die tip 40 may be secured to the adapter 56 by any suitable means, such as fasteners 74. Alternatively, the die tip 40 and adapter 56 may be formed as an integral unit, and secured to modules 14 by cover plate 70. The liquid discharge outlets 64 may be constructed in various configurations to produce a desired form of dispensed liquid, such as filaments or ribbons, as is known in the art. In the exemplary embodiment shown, the outlets 64 are provided on frustoconical protrusions 76 adapted to produce discrete filaments of liquid material. The die tip 40 may also include air discharge outlets 78, proximate the liquid discharge outlets 64, to attenuate and shape the dispensed liquid material, as known in the art.

While the exemplary dispensing system 10 has been described above as utilizing gear pumps 22 to meter the flow of liquid material through individual manifold segments 16 and module assemblies 14, it will be recognized that various other devices may be utilized to meter the flow of liquid material through the manifold segments 16 and modules 14. For example, piston pumps and other types of pumps, or individually controllable pressure sources may be utilized to meter the flow of liquid material through the applicator 12 in a manner similar to that described above, and the description using gear pumps is not intended to restrict the invention.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A liquid dispensing system, comprising:

a plurality of liquid dispensing modules each having a liquid outlet port, each module configured to independently, selectively supply liquid material through said respective liquid outlet port;

a plurality of flow-metering devices each flow-metering device associated with one of said liquid dispensing modules and controlling the flow of liquid material through said respective liquid outlet port; and a die operatively coupled to at least two of said liquid dispensing modules, said die having a plurality of liquid discharge outlets, each liquid discharge outlet in fluid communication with one of said liquid outlet ports such that the flow of liquid material from each said discharge outlet is selectively and independenly controlled by said respective module and said associated flow-metering device.

2. The liquid dispensing system of claim 1, wherein said plurality of flow-metering devices comprise positive displacement pumps.

3. The liquid dispensing system of claim 1, wherein said plurality of flow-metering devices comprise pneumatic pressure sources.

4. The liquid dispensing system of claim 1, wherein said die is configured to dispense a plurality of liquid filaments.

5. The liquid dispensing system of claim 1, wherein said die is configured to dispense a plurality of ribbons of liquid material.

6. The liquid dispensing system of claim 1, further comprising an adapter coupled to said die and having a plurality of liquid passages configured to receive liquid material from said modules at a first spacing arrangement and direct the liquid material to said die for dispensing at a second spacing arrangement.

7. The liquid dispensing system of claim 1, further comprising:

at least one air discharge outlet proximate at least one of said liquid discharge outlets.

8. A method of dispensing liquid material to at least one substrate from an applicator having a plurality of liquid dispensing modules and at least one die operatively coupled to the modules, the die having a plurality of liquid discharge outlets, the method comprising:

selectively supplying the liquid material from each module to one of the liquid discharge outlets of the die;

independently controlling the flow of the liquid material supplied to each of the discharge outlets from a respective module; and forcing the liquid material through each of the discharge outlets.

9. The method of claim 8, wherein forcing the liquid material comprises using respective positive displacement pumps to pump the liquid material through each respective outlet.

10. The method of claim 8, wherein forcing the liquid material comprises using compressed air to force the liquid material through each respective outlet.

11. The method of claim 8, wherein the substrate comprises a plurality of strands, and the method further comprises:

dispensing the liquid material from the plurality of liquid discharge outlets onto the strands.

12. The method of claim 8, wherein the applicator further includes a plurality of air discharge outlets associated with the liquid discharge outlets, the method further comprising:

forcing air through the air discharge outlets and toward the liquid material exiting the liquid discharge outlets.

* * * * *